US006431101B1

(12) United States Patent
Lunde et al.

(10) Patent No.: US 6,431,101 B1
(45) Date of Patent: Aug. 13, 2002

(54) VESSEL COMPRISING A CHAIN HAWSE HAVING A CHAIN SUPPORT ELEMENT

(75) Inventors: Peter A. Lunde, Westlake Village, CA (US); Jack Pollack, Monaco (MC)

(73) Assignee: Single Buoy Moorings Inc., Marly (CH)

( * ) Notice: Subject to any disclaimer, the term of this patent is extended or adjusted under 35 U.S.C. 154(b) by 0 days.

(21) Appl. No.: 09/446,819

(22) PCT Filed: Jun. 30, 1998

(86) PCT No.: PCT/EP98/04173

§ 371 (c)(1),
(2), (4) Date: Mar. 22, 2000

(87) PCT Pub. No.: WO99/01337

PCT Pub. Date: Jan. 14, 1999

(30) Foreign Application Priority Data

Jun. 30, 1997 (EP) ..... 97201987

(51) Int. Cl.[7] ..... B63B 21/14; B66D 3/04
(52) U.S. Cl. ..... 114/179; 254/389
(58) Field of Search ..... 114/179, 180, 114/181, 230.1, 230.2, 230.25, 293, 199, 200; 254/389, 372; 242/615

(56) References Cited

U.S. PATENT DOCUMENTS

| | | | | | |
|---|---|---|---|---|---|
| 176,562 | A | * | 4/1876 | St. Marie | 114/179 |
| 206,837 | A | * | 8/1878 | Sharp | 254/219 |
| 765,933 | A | * | 7/1904 | Nowland | 114/181 |
| 2,977,921 | A | | 4/1961 | Winslow | |
| 4,724,789 | A | * | 2/1988 | Van den Haak | 114/293 |
| 5,517,937 | A | | 5/1996 | Lunde | |
| 5,845,893 | A | * | 12/1998 | Groves | 254/389 |

FOREIGN PATENT DOCUMENTS

| | | | | |
|---|---|---|---|---|
| FR | 2371371 | * | 7/1978 | 114/119 |
| FR | 2 601 322 | | 1/1988 | |
| GB | 954104 | | 4/1964 | |
| RU | 329062 | * | 9/1972 | 114/179 |
| WO | WO 82/00675 | | 3/1982 | |

* cited by examiner

*Primary Examiner*—S. Joseph Morano
*Assistant Examiner*—Andy Wright
(74) *Attorney, Agent, or Firm*—Young & Thompson

(57) ABSTRACT

The disclosure relates to an improved chain hawse (4) having a radius of curvature (p) such that the interlink angle (x) is not more than 15°, preferably not more than 11°. According to one embodiment, the chain hawse (4) comprises an internal support element (11), on which the chain links (7, 8) are supported by two ridges (16, 17) that are relatively narrow and that are placed close together. Hereby the chain links (7, 8) are supported along their short sides near their points of interconnection and long side bending is prevented. According to another preferred embodiment, a support element (30) comprises a wedgeshaped structure with two slanting surfaces (31, 32) along which the planes of adjacent chain links (33, 34) are supported such that bending fatigue problems are mitigated.

9 Claims, 4 Drawing Sheets

VESSEL COMPRISING A CHAIN HAWSE HAVING A CHAIN SUPPORT ELEMENT

BACKGROUND OF THE INVENTION

The invention relates to a vessel comprising a chain hawse and an anchor chain of interconnected chain links, the anchor chain running through the chain hawse which ends in an exit opening in the hull of the vessel and having a predetermined radius of curvature near the exit opening.

In known configurations, the chain hawse is curved near the opening in the hull to accommodate different angles of pull on the anchor chain. The chain links in such a case are subject to interlink wear due to constant small movements of the chain links. Also the wall of the chain hawse will in the curved region be subject to wear as the chain links rub against the chain hawse wall. By the curvature of the chain hawse, the interlink wear can be spread over a few chain links.

Most state of the art designs for chain hawses, such as for instance described in OTC publication no. 3855, presented at the 12th Annual OTC in Houston, Tex., May 5–8, 1980. Title: "Strength of chain tensioned over a curved surface", by John F. Flory, and Steve P. Woehleke, Exxon Research and Engineering Co. are laid out to be able to withstand extreme forces during gale conditions and during high seas when the anchor chain has a maximum angle with respect to the vessel. The curved part of the known chain hawse is long enough to distribute the acting forces over a sufficiently large number of links, such that the bending fatigue of each link is reduced.

From FR-A-260 1322 it is known that for reduction of wear of the chain hawse wall, a steel support element may be applied, having a central groove for the transverse chain links, and forming a support surface for the chain links that are oriented substantially parallel to the chain hawse wall. Such a construction effectively protects the chain hawse wall and stabilises the chain position, but may still result in significant bending forces on each link.

In again another attempt to reduce chain hawse wear, a rub casting is applied on the chain, in combination with a straight or curved chain hawse. The rub casting, which may be formed of steel, prevents the chain links from contacting the chain hawse wall, but causes interlink wear of the one or two links closest to the rub casting.

In all of the above constructions, the interlink wear is relatively large. Furthermore, in the construction without the protective support element and in the construction in which a rub casting is used, chain hawse wear may be problematic. Finally, the use of a curved chain hawse may lead to chain bending fatigue problems due to point contact of the chain with the sides of the hawse on the long sides of the links.

SUMMARY OF THE INVENTION

It is an object of the present invention to provide a chain hawse for a dynamically moving anchor chain in which the effects of interlink wear are at least substantially reduced. It is a further object of the present invention to provide a chain hawse wherein the bending fatigue for each chain link as well as chain hawse wear are at least substantially reduced.

Thereto a vessel, according to a first embodiment of the invention, is characterised in that the curvature of the chainhawse is such that the interlink angle is less than 15°, preferably less than 11°.

By reducing the radius of curvature of the chain hawse wall, or by using a relatively large number of smaller chain links the interlink wear can be significantly reduced.

The invention is based on the insight that interlink wear and bending fatigue are largely due (e.g. for 90%) to the continuous little dynamic moments of the anchor chain and for less due to extreme weather conditions (e.g. 10%). During normal operation, the chain angle with respect to the horizontal, which normally can amount to for instance about 50°, varies by a maximum of plus or minus 10 degrees. Contrary to the state of the art chain hawses in which a smaller curvature is distributed over the entire hawse pipe resulting in interlink angles between 20° and 70°, the present invention minimises the interlink wear by the use of relatively small interlink angles in the area of the hawse pipe where most of the normal wear occurs.

According to a further embodiment of the present invention, the curved part of the chain hawse is along at least a part of its length provided with a chain support element for supporting the chain links. The chain support element comprises two oppositely located, parallel ridges extending in the length direction of the chain. Each ridge, when seen along the transverse center line of the chain links that are supported on said ridge, is substantially located within the area that is defined by the internal dimension of the chain links. The internal dimension is defined by the distance between the centers of the parallel chain link parts in a chain link along the transverse centre line.

Hereby, the chain links are supported by the ridges in four points on the short sides of the links. No substantial contact forces along the long sides of the links with the support element are present, such that long side bending and the associated bending fatigue is significantly reduced or eliminated altogether.

Preferably the height of the support ridges is sufficient to maintain a clearance of the chain links with the chain hawse wall for further reduction of long side bending. The supporting ridges may be formed by a stepped support member attached to the chain hawse wall or by the sharp edges of a slanting support member.

According to a preferred embodiment of the present invention, the chain support element comprises two support surfaces that include a predetermined angle, the planes of two adjacent chain links being located on different support surfaces.

By placing the plane of the chain links at an angle with respect to the chain hawse wall and by supporting each link in its plane on the support element, a favourable force distribution is obtained and long side bending is eliminated to a large extent. Preferably the angle between the planes of two adjacent chain links is about 90°, the angle between a chain link and the chain hawse wall being about 45°, and the angle between the slanting support surfaces being about 90°.

In both embodiments wherein support surfaces are used on the chain hawse wall, the interlink angle may be less than 15°, preferably not more than 11°.

BRIEF DESCRIPTION OF THE DRAWINGS

A number of embodiments of a vessel having an improved chain hawse construction according to the present invention shall, by way of example, be explained in detail with reference to the accompanying drawings. In the drawings.

DESCRIPTION OF THE PREFERRED EMBODIMENTS

Figure 1:
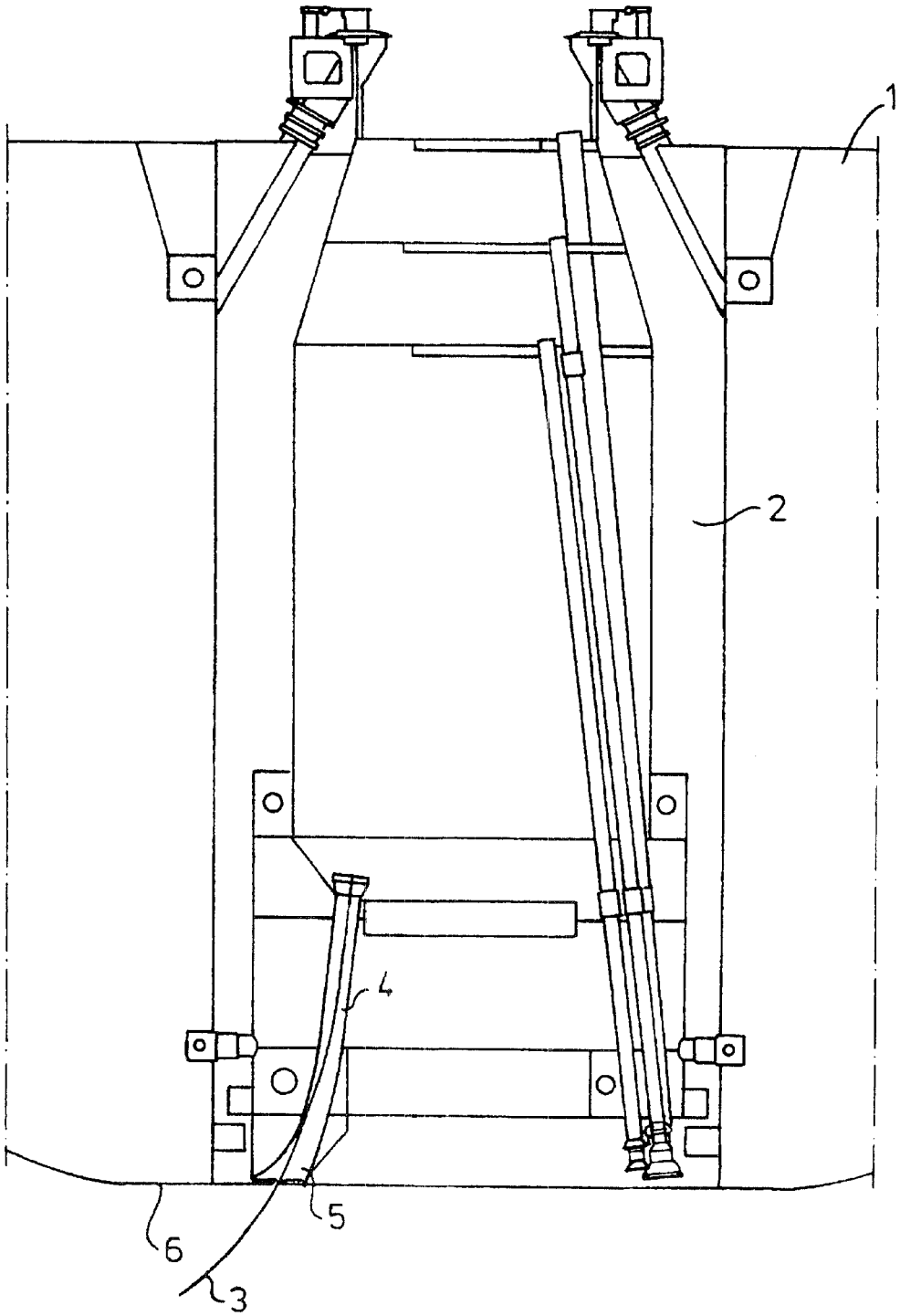
FIG. 1 shows a schematic side view of a part of vessel comprising a chain hawse according to a first embodiment of the present invention.
Figure 2:
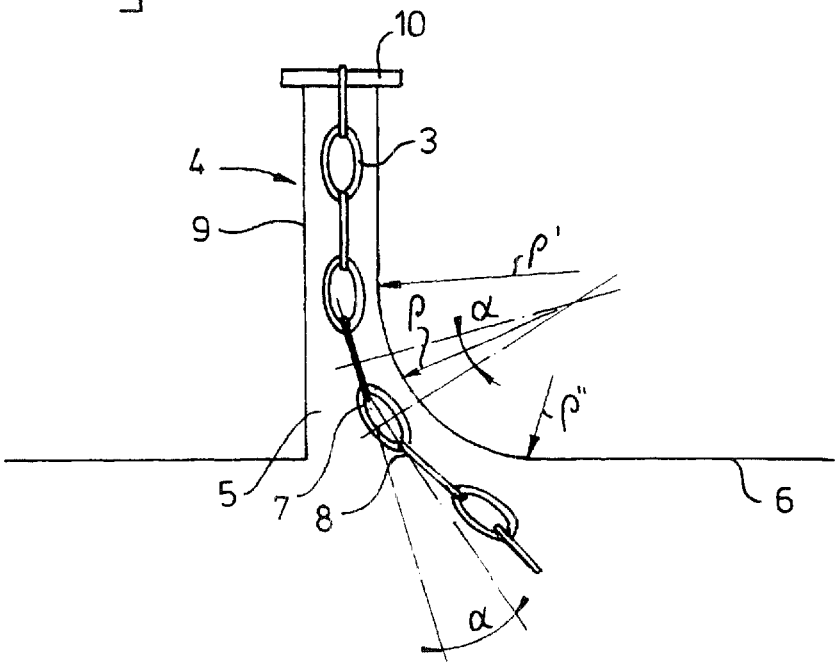
FIG. 2 shows an enlarged detail of the lower part of the chain hawse of FIG. 1, showing the interlink angle $\alpha$.

FIG. 1 shows a vessel 1, comprising a central turret structure 2, around which the vessel 1 can weathervane. The turret structure 2 is connected to the seabed by one or more anchor chains 3 which are running through a chain hawse 4. The anchor chain 3 is fixed in position with respect to the chain hawse pipe 9 by a chain stopper 10, as shown in FIG. 2. Near the exit opening 5 in the hull 6 of the vessel or at the bottom of a turret, the chain hawse 4 is curved. As shown in FIG. 2, the radius of curvature ρ of the chain hawse 4, is such that the interlink angle α between two successive links 7 and 8 is not more than 11° in the area of normal operating conditions. The interlink angle α is defined as the angle that is included by the radii which are perpendicular to the centre lines of two adjacent chain links.

In the area defined by ρ', the chain will be contacting the chain hawse wall under slack conditions, during about 10% of the time. The area of the chain hawse wall having a radius of curvature by ρ" is contacted by the chain during extreme conditions, such as during gales, also for about 10% of the operating time. The area of normal operating conditions (80%) is defined by a curvature ρ for which the small interlink angle according to the present invention applies.

Figure 3:
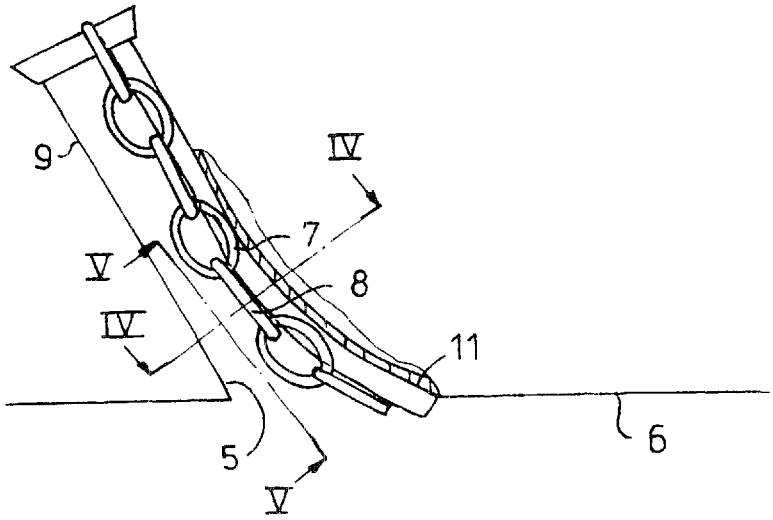
FIG. 3 shows a side view of a chain hawse comprising a support element according to the invention.
Figure 4:
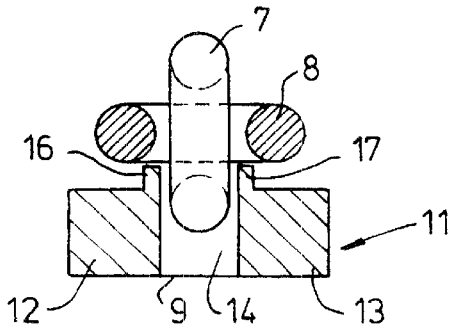
FIGS. 4 and 5 show a cross-sectional view along the line IV—IV and along the line V—V respectively, of the support element of FIG. 3.

As shown in FIG. 3, a support element 11 is connected to the wall of the chain hawse pipe 9, in the area near the exit opening 5. The transverse chain elements 7 are placed with their long sides in a central groove between two adjacent support ridges, whereas the chain elements 8 are supported on the ridges of the support element 11. As can be seen in FIG. 4, the support element 11 comprises two stepped members 12, 13 each having a ridge 16,17 on the side closest to the transverse chain link 7. The ridges 16,17 are relatively narrow and are placed in close proximity to the central groove 14. Thereby, the chain links 8 which have their planes substantially parallel to the ridges 16,17, are supported in four areas on the short sides of the chain links. The height of the ridges 16, 17 is such that the lower ends of the transverse chain links 7 do not touch the wall of the chain hawse pipe 9.

Figure 5:
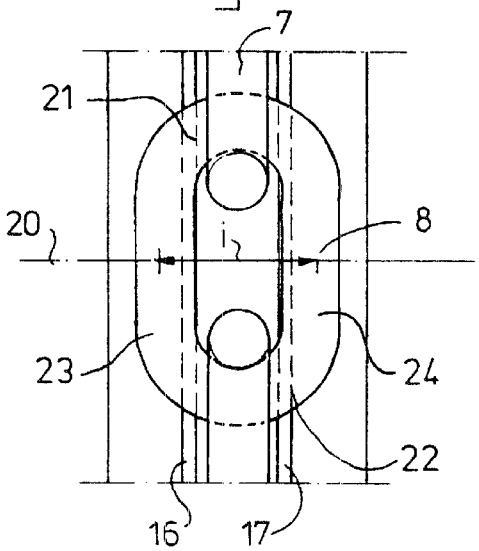

As can be seen in FIG. 5, the chain link 8 has an inner dimension i along the transverse centreline 20 corresponding to the distance between the centres of the two opposite and parallel long sides 23,24 of the chain link. The ridges 16, 17 are located within the inner dimension i, such that the link 8 is supported on the ridges 16,17 in four points along the short sides 21,22 of the chain link 8. The four supporting points are located close to the interlink points where the adjacent links 7 and 8 are interconnected. The long sides 23,24 of the link 8 are substantially free, such that longs side bending of the link 8 is reduced.

Figure 6:
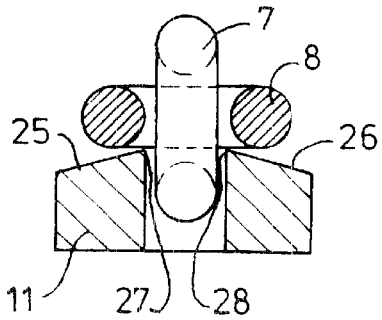
FIG. 6 shows a cross-sectional view of another embodiment of a support element of the type as shown in FIG. 4, and FIGS. 7 and 8 show a side view and a cross-sectional view along the line VIII—VIII, respectively, of a preferred embodiment of a support element wherein each chain link is supported on alternating support surfaces.

FIG. 6 shows an embodiment wherein the support element 11 comprises two slanting surfaces 25,26. The edges 27,28 of the slanting surfaces 25,26 carry the chain link 8, again on the short sides thereof. The surfaces 25,26 may extend outwardly beyond the inner dimension i of the chain link, as shown in FIG. 5, as long as the edges 27 and 28 are located within this area.

Figure 7:
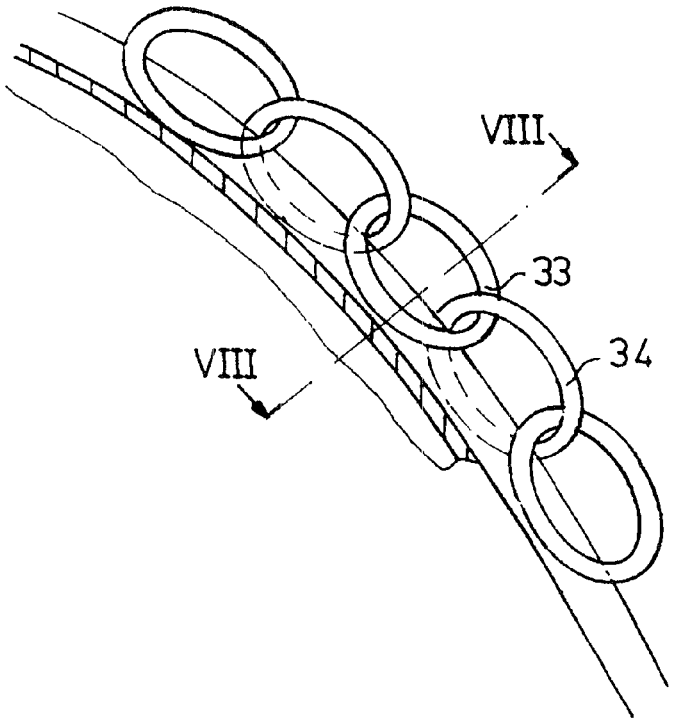
Figure 8:
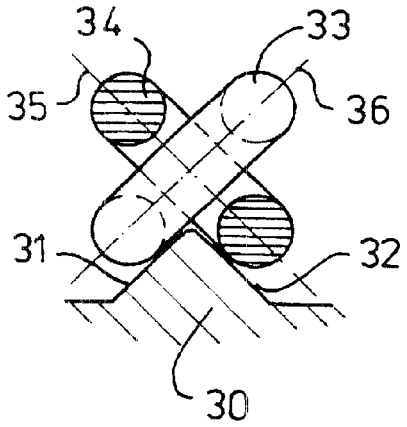

Finally, FIGS. 7 and 8 shows an embodiment wherein a support element 30 is used comprising two support surfaces 31, 32. The surfaces 31, 32, as shown in FIG. 8, include an angle which, in the embodiment shown, amounts to 90°, but this angle may be varied. As can be seen in FIG. 8, the planes 35,36 of two adjacent chain links 33, 34 are located each time along a different support surface 31, 32. By the support element 30 according to this preferred embodiment, all chain links are supported evenly along their planes 35,36 and localised stresses on the long sides are prevented. The invention is not limited to a chain hawse which extends in a vertical direction but can also be used for a substantially horizontal chain hawse such as used in a spread mooring system.

What is claimed is:

1. A vessel (1) comprising a chain hawse (4) and at least one anchor chain (3) of interconnected chain links (7, 8), each chain link comprising a transverse center line (20) and having an inner dimension (i) along said center line, the anchor chain (3) running through the chain hawse (4) which ends in an exit opening (5) in the vessel and which has a predetermined radius of curvature (ρ) near the exit opening, a curved part of the chain hawse being along at least a part of its length provided with a chain support element (11) for supporting the chain links (7, 8), the chain support element (11) comprising two oppositely located, parallel ridges (16, 17, 27, 28) extending in the length direction of the chain and having said radius of curvature, each ridge (16, 17, 27, 28), when seen along the transverse center line (20) of the chain links that are supported on said ridges, being substantially located within the area defined by the inner dimension (i) of the chain links (7, 8) and supporting the chain links whose transverse center line is parallel to a plane tangential to the curved part of said chain hawse.

2. The vessel (1) according to claim 1, wherein the chain support element (11) has a stepped surface, the steps forming the ridges (16, 17).

3. The vessel (1) according to claim 1, wherein the chain support element (11) comprises two slanting surfaces (25, 26), the parts of which that are located closest together forming the ridges (27, 28).

4. The vessel (1) according to claim 1. wherein a curvature of the chain hawse (4) is such that an interlink angle (α) is less than 15°.

5. A vessel (1) comprising a chain hawse (4) and an anchor chain (3) of interconnected chain links (33, 34), each chain link comprising a closed contour defined in a predetermined plane (35, 36), the anchor chain running through the chain hawse (4) which ends in an exit opening (5) in the vessel (1) and which has a predetermined radius of curvature near the exit opening, a curved part of the chain hawse being along at least a part of its length provided with a chain support element (30) for supporting the chain links (33, 34), the chain support element (30) being triangular in cross section with a base parallel to a plane tangential to a surface of the chain hawse and comprising two support surfaces (31, 32) that are sides of the triangular claim support element and that include a predetermined angle, the predetermined planes (35, 36) of two adjacent chain links (33, 34) being located along different support surfaces (31, 32).

6. The vessel (1) according to claim 5, wherein the predetermined angle between the support surfaces (31, 32) is about 90°.

7. A vessel (1) comprising a chain hawse (4) and at least one anchor chain (3) of interconnected chain links (7, 8), each chain link comprising a transverse center line (20) and having an inner dimension (i) along said center line, the anchor chain (3) running through the chain hawse (4) which ends in an exit opening (5) in the vessel and which has a predetermined radius of curvature (ρ) near the exit opening, a curved part of the chain hawse being along at least a part of its length provided with a chain support element (11) for supporting the chain links (7, 8), the chain support element (11) comprising two oppositely located, parallel ridges (16, 17, 27, 28) extending in the length direction of the chain and having said radius of curvature, each ridge (16, 17, 27, 28), when seen along the transverse center line (20) of the chain links that are supported on said ridges, being substantially located within the area defined by the inner dimension (i) of the chain links (7, 8), wherein the chain support element (11) comprises a central groove (14) between the ridges (16, 17, 27, 28) for receiving transverse chain links (7) therein, and wherein a height of the support ridges (16, 17, 27, 28) is sufficient for maintaining a clearance between the transverse chain link (7) and a wall (9) of the chain hawse (4).

8. The vessel (1) according to claim 7, wherein the chain support element (11) has a stepped surface, the steps forming the ridges (16, 17).

9. The vessel (1) according to claim 7, wherein the chain support element (11) comprises two slanting surfaces (25, 26), the parts of which that are located closest together forming the ridges (27, 28).

* * * * *